US007937796B2

(12) United States Patent
Benjumea Marcos Merced

(10) Patent No.: US 7,937,796 B2
(45) Date of Patent: May 10, 2011

(54) WIPING MOP AND FOOT PEDAL THEREFOR

(75) Inventor: María de la Benjumea Marcos Merced, Saulx les Charteaux (FR)

(73) Assignee: Carl Freudenberg, KG, Weinheim (DE)

( * ) Notice: Subject to any disclaimer, the term of this patent is extended or adjusted under 35 U.S.C. 154(b) by 1057 days.

(21) Appl. No.: 11/575,457

(22) PCT Filed: Sep. 23, 2005

(86) PCT No.: PCT/EP2005/010300
§ 371 (c)(1),
(2), (4) Date: Mar. 16, 2007

(87) PCT Pub. No.: WO2006/048081
PCT Pub. Date: May 11, 2006

(65) Prior Publication Data

US 2008/0060157 A1 Mar. 13, 2008

(30) Foreign Application Priority Data

Nov. 4, 2004 (DE) ..... 10 2004 053 837

(51) Int. Cl.
*A47L 13/20* (2006.01)

(52) U.S. Cl. ..... 15/228; 15/119.1

(58) Field of Classification Search ..... 15/119.1, 15/228, 143.1, 246, 248.1
See application file for complete search history.

(56) References Cited

U.S. PATENT DOCUMENTS

| | | | | |
|---|---|---|---|---|
| 1,652,820 | A | 12/1927 | Evans | |
| 1,735,280 | A * | 11/1929 | Hertzberg | 15/120.2 |
| 1,787,185 | A | 12/1930 | Baird | |
| 2,063,132 | A * | 12/1936 | Sund | 15/246 |
| 2,774,093 | A | 12/1956 | King | |
| 5,319,823 | A * | 6/1994 | Baum et al. | 15/160 |
| 6,108,848 | A | 8/2000 | Monahan | |
| 6,477,731 | B2 * | 11/2002 | Monahan | 15/120.1 |
| 6,684,445 | B1 | 2/2004 | Rios et al. | |
| 7,065,823 | B2 * | 6/2006 | Llanes | 15/119.1 |
| 2002/0092105 | A1 | 7/2002 | Laux et al. | |

FOREIGN PATENT DOCUMENTS

| | | | |
|---|---|---|---|
| BE | 47 27 62 | A | 5/1947 |
| GB | 443523 | A | 3/1936 |
| GB | 2 036 549 | A | 7/1980 |
| WO | WO 2004/021851 | A1 | 3/2004 |

* cited by examiner

*Primary Examiner* — Laura C Guidotti
(74) *Attorney, Agent, or Firm* — Leydig, Voit & Mayer, Ltd.

(57) ABSTRACT

The invention relates to a wiping mop comprising a mop head (1) provided with at least one cleaning body (2), wherein said mop head (1) is connected to a handle (3), the mop head (1) and a handle (3) comprise a circular foot pedal (4) for wringing the cleaning body (2) by means of a wringing system or a device and the pedal (4) is concentrically associated with the mop head (1) or concentrically encompasses the handle (3) on the side oriented to the mop head (1).

16 Claims, 2 Drawing Sheets

WIPING MOP AND FOOT PEDAL THEREFOR

FIELD OF TECHNOLOGY

The invention relates to a cleaning mop and to a foot lever for this mop.

The cleaning mop contains a mop head with at least one cleaning body, where the mop head is connected to a handle. The cleaning body can be composed of, for example, a plurality of fringes.

STATE OF THE ART

Such cleaning mops are generally known and are used for cleaning floors. Previously known cleaning mops are used, for example, together with buckets, which have a wringing mechanism or device for wringing the cleaning body.

For wiping the surface to be cleaned, here the cleaning mop is immersed with the cleaning body fixed to the mop head into the liquid located in the bucket, so that the cleaning body can be completely soaked. To remove an excess of liquid from the cleaning body, this body is pressed in the wringing mechanism or device, with the efficiency of the wringing process depending greatly on the force exerted by hand via the handle and the cleaning head to the cleaning body by the user of the cleaning mop.

Especially for cleaning sensitive surfaces, frequently a cleaning body that is only slightly moist is necessary. In particular, operators that are rather weak are able to wring out the cleaning body as much as possible only with great effort. Handling previously known cleaning mops is also troublesome for those with arthrosis and/or back pain, because often they are not able to apply the necessary force to the cleaning body to wring it out as much as possible with their hands via the handle and the mop head.

DESCRIPTION OF THE INVENTION

The invention is based on the problem of refining a cleaning mop of the type named above so that this mop is easy to handle, especially so that wringing out the cleaning body is simplified. Especially users of the wiper mop are able to wring out the cleaning body without trouble with less force and/or physical exertion.

To solve the problem, a cleaning mop is provided comprising a mop head with at least one cleaning body, wherein the mop head is connected to a handle, has a circular foot lever for wringing out the cleaning body in a wringing mechanism or device, and the foot lever is arranged concentrically to the mop head.

This problem is also solved by a cleaning mop comprising a mop head with at least one cleaning body, wherein the mop head is connected to a handle, the handle has a circular foot lever for wringing out the cleaning body in a wringing mechanism or device, and the foot lever surrounds the handle concentrically on the side facing the mop head.

The circular foot lever allows the user to exert force with one foot, in addition to the force exerted via the handle to the mop head and thus to the cleaning body, in order to achieve a better wringing result. The user can distribute the force for wringing out the cleaning body variably between the hands and feet, wherein there is also the possibility to guide the handle of the cleaning mop by hand and to exert force onto the cleaning body exclusively through a foot via the foot lever. The circular shape of the foot lever and its concentric allocation to the mop head or its concentric arrangement on the side of the handle facing the mop head is an advantage, because such a foot lever can be activated selectively without a problem with the left or the right foot of the user. The foot lever is always located in an optimum position/allocation on the cleaning mop, independently of the tilt of the mop head or the handle, so that it does not require adjustments of the foot lever during the use by the user; swinging of the foot lever or handle in the direction of the force of gravity and a resulting unfavorable position of the foot lever for the user is reliably excluded by the circular construction of the foot lever.

The foot lever is shaped so that a sufficiently large force can also be exerted by the foot of the user when it is moist, for example. The foot lever can have, for example, increased surface roughness, for example, by means of profiling, which prevents the foot of the user from slipping from the foot lever when wringing out the cleaning body.

The foot lever is located either on the side of the handle facing the mop head or in the top area of the mop head, that is, arranged so that the foot lever can be easily reached with one foot. By arranging the foot lever are close as possible to the side of the cleaning mop facing the cleaning body, the wringing out of the cleaning body in a wringing mechanism or device is not problematic in regard to the risk of tipping the bucket with the wringing mechanism or device since the application of force is reduced to a minimum in the immediate vicinity of the cleaning body. Therefore, secure but nonetheless efficient wringing out of the cleaning body is possible.

The foot lever can be manufactured separately relative to the mop head or handle. Here, it is advantageous that the foot lever can also be used, for example, as a separately manufactured individual part in connection with differently shaped cleaning mops. In addition, foot levers with different dimensions can be used, so that a foot lever adapted to each application and/or user can be used on the cleaning mop. Therefore, good adaptation to the corresponding conditions of the application is possible.

The foot lever can be fixed with attachment means to the mop head or handle. The attachment means can be formed, for example, by screws or a snap-on connection.

The foot lever can have a circular step surface or a circular collar. For a circular step surface, the foot contact surface is greater, which is advantageous in terms of especially simple activation. The collar is advantageous because no cleaning liquid can collect on the collar. The collar is therefore always especially slip-proof.

The foot lever can have on the radial inner side a hollow guide cylinder, which is surrounded by the step surface or the collar on the outer peripheral side and is fixed in place with this step surface or collar, where the foot lever is connected to the mop head or the handle in such a way that it can rotate and/or move longitudinally. Here, it is advantageous that such a foot lever is simply threaded onto the end of the handle facing away from the mop head and can move in the direction of the mop head. The hollow guide cylinder and the step surface or the collar can be slotted, for example, at one position of its periphery, where the foot lever is able to be snapped onto the mop head or the handle in the radial direction.

The guide cylinder and the step surface can be connected to each other with a positive and/or non-positive connection. The guide cylinder and the collar can be connected to each other with a positive and/or non-positive connection by means of at least two, preferably at least three, spokes extending in the radial direction. For example, the guide cylinder and the step surface or the collar can be manufactured integrally, one transitioning into the other, and from the same material. A connection of the two parts by means of adhesive and/or clamps can also prove to be advantageous with respect to a simple and economical manufacture of the foot lever.

According to another configuration, the foot lever can be constructed integrally with and from the same material as the mop head or the handle. The foot lever is therefore stationary and rigid relative to the mop head or the handle. If, for example, the foot lever is connected to the mop head integrally and from the same material, then different handles—without a foot lever—can be used and the advantageous characteristics of use of the cleaning mop due to the foot lever are maintained. In contrast, if the foot lever is connected to the handle integrally and from the same material, then this handle can be connected to different mop heads, each without a foot lever.

The foot lever preferably has a step surface with a width of 3 to 5 cm or a collar that surrounds the handle on the outer peripheral side with a spacing of 3 to 5 cm. Such a width/spacing corresponds at least approximately to half the width of an adult human foot. The width/spacing further advantageously equals 4 cm. For a width/spacing of less than 3 cm, there is the risk that the foot of the user will slip, especially when the step surface is moist and/or wetted with slippery cleaning agents. In contrast, if the width/spacing is greater than 5 cm, the cleaning mop becomes unwieldy, because there is the risk, for example, of damaging furniture with the peripheral edge of the foot lever when cleaning.

The foot lever can consist of a polymer material. Such a foot lever is lightweight, so that the easy handling of a cleaning mop without a foot lever is essentially maintained. In addition, it is advantageous that such a foot lever be rustproof.

The invention also relates to a foot lever for a cleaning mop as described above, wherein the foot lever has a circular construction.

BRIEF DESCRIPTION OF THE DRAWINGS

Six embodiments are explained in more detail below with reference to FIGS. 1 to 6. Shown are:

In FIGS. 1 to 3, the foot lever includes a step surface.

In FIGS. 4 to 6, the foot lever includes a collar.

CONSTRUCTION OF THE INVENTION

FIGS. 1, 2, 4, and 5 each show an embodiment of a cleaning mop comprising a mop head 1, to which a cleaning body 2 is attached. The cleaning body 2 is composed of a plurality of fringes, which are arranged in the shape of a bell. In each of the four embodiments, the mop head 1 is connected to a handle 3, where the center part of the handle 3 is not shown in FIGS. 2 and 5.

Figure 3:
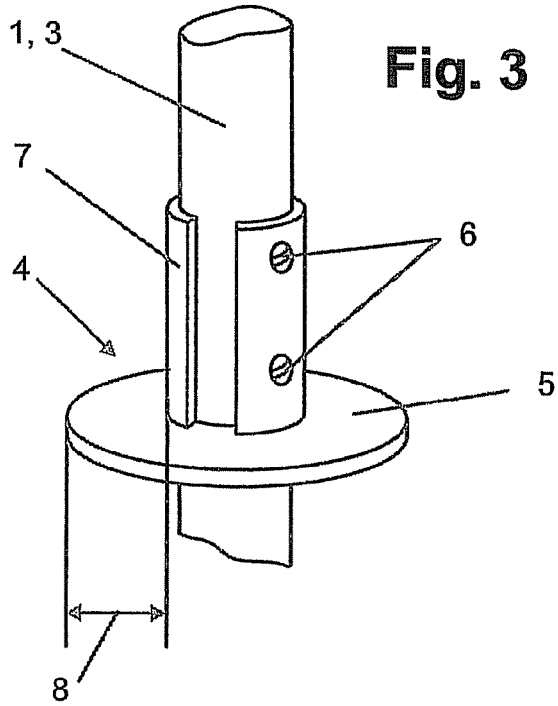
Figure 6:
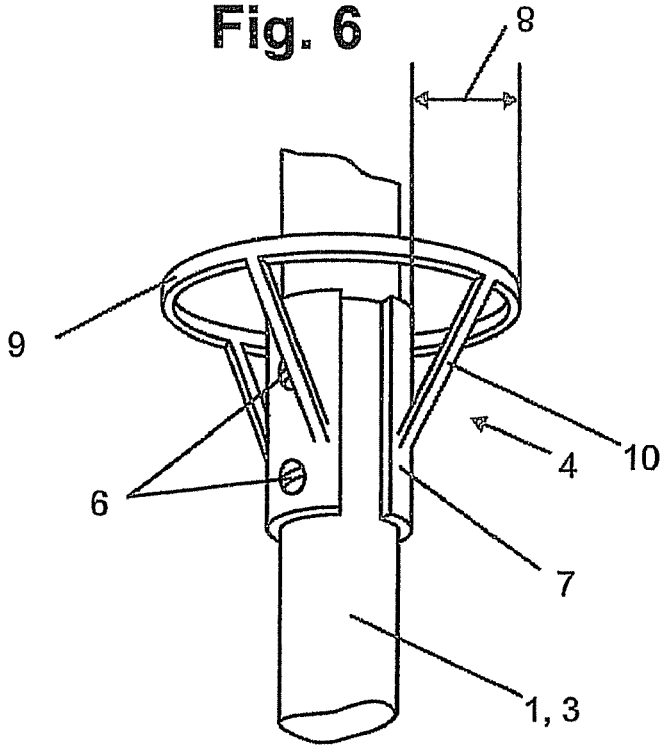

FIGS. 3 and 6 each show a cutout from a cylindrical part, which can be a component of the mop head 1 or a component of the handle 3.

Figure 4:
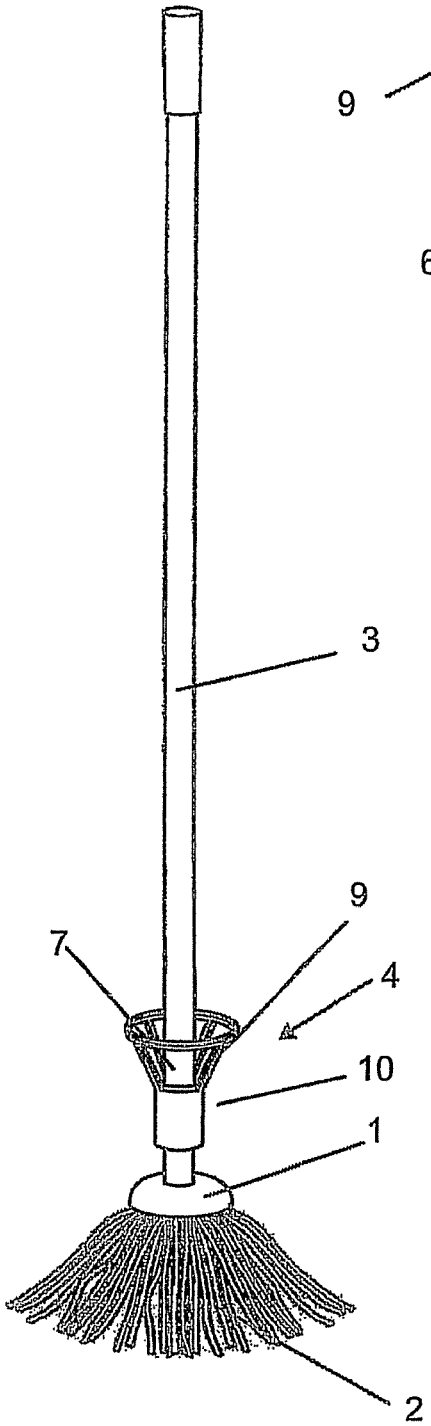
FIG. 4, a third embodiment, in which the foot lever is connected to the handle, FIG. 5, a fourth embodiment, in which the foot lever is connected to the mop head, and FIG. 6, a possible attachment of a foot lever on the handle or on the mop head.
Figure 5:
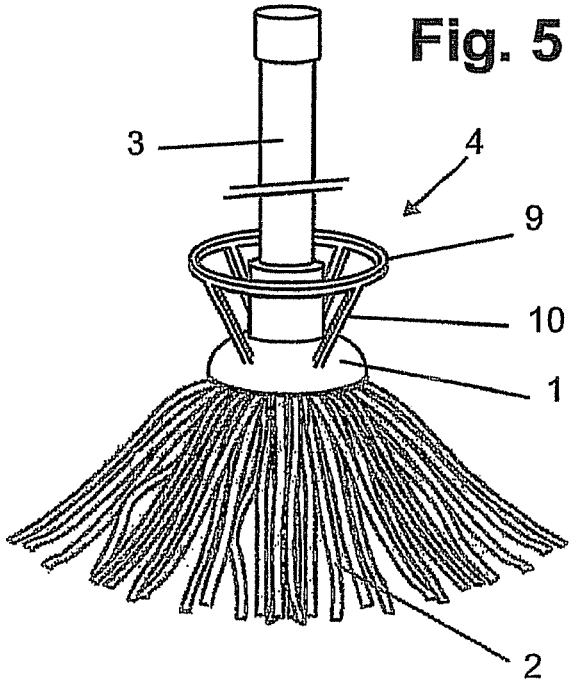

In each of the six embodiments, a circular foot lever 4 is shown, with a circular step surface 5 (FIGS. 1 to 3) or a circular collar 9 (FIGS. 4 to 6).

The step surface 5 or the collar 9 of the foot lever 4 can be used by the user to wring out the cleaning body 2 in a wringing mechanism or device, wherein this wringing process can be performed so that either the user wrings out the cleaning body 2 by hand by means of the handle 3 and also through his foot force by means of the foot lever 4 or exclusively through his foot force by means of the foot lever 4, wherein the handle 3 is then guided merely by hand. All of the foot levers 4 shown in FIGS. 1 to 6 can be produced either separately, in terms of the mop head 1 or handle 3, and then completed with the other components to form the cleaning mop according to the invention or the corresponding foot lever 4 can form an integral component of the same material as the mop head 1 or the handle 3.

Figure 1:
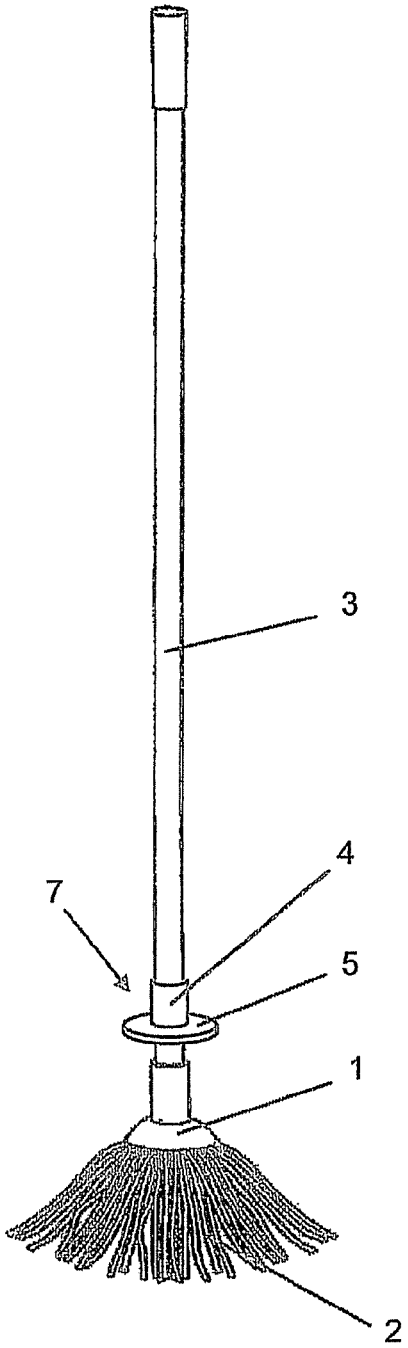
FIG. 1, a first embodiment of the cleaning mop according to the invention, in which the foot lever is connected to the handle, FIG. 2, a second embodiment, in which the foot lever is connected to the mop head, and FIG. 3, a possible attachment of a foot lever on the handle or on the mop head.

FIG. 1 shows a first embodiment of the cleaning mop according to the invention. The circular foot lever 4 concentrically surrounds the handle 3 on the side facing the mop head 1. The foot lever 4 surrounds a guide cylinder 7, which can be fixed on the handle 3, for example, by means of the attachment means 6 shown in FIG. 3.

The guide cylinder 7, however, can also be threaded and arranged on the handle 3 of the cleaning mop so that it can rotate and/or move longitudinally.

Figure 2:
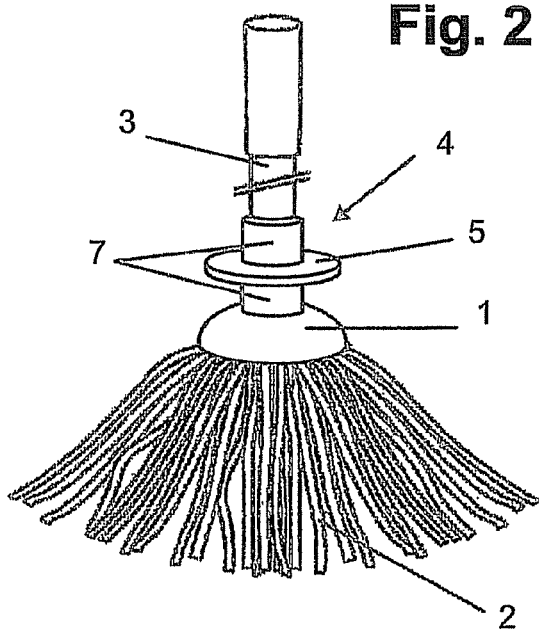

FIG. 2 shows a second embodiment of a cleaning mop, in which the foot lever 4 is arranged concentrically to the mop head 1. In the embodiment shown here, there is also the possibility both that the foot lever 4 will be attached, as shown in FIG. 3, to the mop head 1 with attachment means 6 or will be connected to the mop head 1 so that it can rotate and/or move longitudinally. Both in the embodiment from FIG. 1 and also in the embodiment from FIG. 2, the foot lever 4 can be constructed integrally and from the same material with the handle 3 (FIG. 1) or the mop head 1 (FIG. 2).

One embodiment of possible attachment means 6 is shown in FIG. 3. Here, the attachment means 6 are formed by screws, which penetrate an essentially cylindrical guide 7 and which are screwed to the handle 3 (FIG. 1) or the mop head 1 (FIG. 2).

The foot lever 4 has a width of 8 to 5 cm in all of the shown embodiments, in order to guarantee good handling.

FIG. 4 shows an embodiment similar to the embodiment of FIG. 1.

FIG. 5 shows an embodiment similar to the embodiment of FIG. 2, and

FIG. 6 shows an embodiment similar to the embodiment of FIG. 3, with each of these embodiments having a collar 9 with spokes 10 for use instead of the step surface 5. The circular collar 9 is connected to an abutment, which is formed, for example, by the guide cylinder 7 (FIG. 4) or the mop head 1 (FIG. 5), by four spokes 10 extending in the radial direction. The spokes 10 are distributed uniformly in the peripheral direction and extend, from a radially outer position, as viewed in the axial direction of the mop, radially inwards in a V-shape, from the collar 9 towards the mop head 1, the handle 3, or the guide cylinder 7. Through such an arrangement, the spokes 10 are not exposed to any of the tensile forces reducing the service life during the use of the foot lever 4. Therefore, the foot lever 4 has good characteristics of use during a long service life.

Each of the foot levers 4 shown here is composed of a polymer material, wherein the polymer material of the foot lever 4 preferably corresponds to the polymer material of which the component to which it is attached is also preferably composed. Especially when the foot lever 4 is constructed integrally with the mop head 1 or the handle 3, with one transitioning into the other, the material uniformity is especially advantageous, because recycling of the used polymer materials is considerably simplified in this way.

The invention claimed is:

1. A cleaning mop comprising a mop head with at least one cleaning body, wherein the mop head is connected to a handle, wherein the mop head has a circular foot lever configured for wringing out the cleaning body in a unattached wringing mechanism or device that is separate from the foot lever and the cleaning mop, and wherein the foot lever is arranged, concentrically to the mop head, wherein the foot lever has a hollow guide cylinder on an inner side in the radial direction, which is surrounded by a step surface or a collar on the outer peripheral side and which is fixed in place with the step surface or collar, and that the foot lever is connected to the mop head so that it can rotate and/or move longitudinally, the guide cylinder and the step surface or collar being connected to each other by at least two spokes extending in the radial direction with a positive and/or non-positive connection.

2. The cleaning mop according to claim 1, wherein the foot lever can be manufactured separately, with respect to the mop head.

3. The cleaning mop according to claim 2, wherein the foot lever can be attached to the mop head with attachment elements.

4. The cleaning mop according to claim 1, wherein the step surface or collar is circular.

5. The cleaning mop according to claim 1, wherein the foot lever is constructed integrally with and from the same material as the mop head.

6. The cleaning mop according claim 1, wherein the step surface has a width of 3 to 5 cm or the collar surrounds the handle with a spacing of 3 to 5 cm.

7. The cleaning mop according to claim 1, wherein the foot lever is composed of a polymer material.

8. The cleaning mop according to claim 1, wherein the foot lever comprises a circular construction.

9. A cleaning mop comprising a mop head with at least one cleaning body, wherein the mop head is connected to a handle, wherein the handle has a circular foot lever configured for wringing out the cleaning body in a unattached wringing mechanism or device that is separate from the foot lever and the cleaning mop, and wherein the foot lever concentrically surrounds the handle on the side facing the mop head, wherein the foot lever has a hollow guide cylinder on an inner side in the radial direction, which is surrounded by a step surface or a collar on the outer peripheral side and which is fixed in place with the step surface or collar, and that the foot lever is connected to the mop head so that it can rotate and/or move longitudinally, the guide cylinder and the step surface or collar being connected to each other by at least two spokes extending in the radial direction with a positive and/or non-positive connection.

10. The cleaning mop according to claim 9, wherein the foot lever can be manufactured separately, with respect to the handle.

11. The cleaning mop according to claim 10, wherein the foot lever can be attached to the handle with attachment elements.

12. The cleaning mop according to claim 10, wherein the step surface or collar is circular.

13. The cleaning mop according to claim 9, wherein the foot lever is constructed integrally with and from the same material as the handle.

14. The cleaning mop according claim 9, wherein the step surface has a width of 3 to 5 cm or the collar surrounds the handle with a spacing of 3 to 5 cm.

15. The cleaning mop according to claim 9, wherein the foot lever is composed of a polymer material.

16. The cleaning mop according to claim 9, wherein the foot lever comprises a circular construction.

* * * * *